US012535210B2

(12) United States Patent
Kaasjager et al.

(10) Patent No.: US 12,535,210 B2
(45) Date of Patent: Jan. 27, 2026

(54) GAS BURNER AND DOMESTIC APPLIANCE

(71) Applicant: Intell Properties B.V., Duiven (NL)

(72) Inventors: Antonie Dirk Johannes Kaasjager, Duiven (NL); Martin Van Bruggen, Duiven (NL); Tycho Melijn Schekermans, Duiven (NL)

(73) Assignee: Intell Properties B.V., Duiven (NL)

( * ) Notice: Subject to any disclaimer, the term of this patent is extended or adjusted under 35 U.S.C. 154(b) by 895 days.

(21) Appl. No.: 17/784,419

(22) PCT Filed: Dec. 11, 2020

(86) PCT No.: PCT/IB2020/061818

§ 371 (c)(1),
(2) Date: Jun. 10, 2022

(87) PCT Pub. No.: WO2021/116996

PCT Pub. Date: Jun. 17, 2021

(65) Prior Publication Data

US 2023/0003379 A1 Jan. 5, 2023

(30) Foreign Application Priority Data

Dec. 11, 2019 (NL) ..... 2024427

(51) Int. Cl.
*F23D 14/64* (2006.01)
*F23D 14/06* (2006.01)

(52) U.S. Cl.
CPC ..... *F23D 14/64* (2013.01); *F23D 14/065* (2013.01); *F23D 2203/007* (2013.01)

(58) Field of Classification Search
CPC ..... F23D 14/64; F23D 14/065; F23D 14/60; F23D 2203/007; F23D 2900/00003; F23D 2900/14642

(Continued)

(56) References Cited

U.S. PATENT DOCUMENTS 2,383,641 A * 8/1945 Focke ..... F04F 5/467 236/75
3,597,135 A 8/1971 Kweller et al.
(Continued)

FOREIGN PATENT DOCUMENTS

CN 101457929 A 6/2009
EP 0800040 A1 10/1997
(Continued)

OTHER PUBLICATIONS

International Search Report and Written Opinion, PCT Application No. PCT/IB2020/061818, mailed Mar. 5, 2021 (8 pages).

*Primary Examiner* — Vivek K Shirsat
(74) *Attorney, Agent, or Firm* — J. Robin Rohlicek

(57) ABSTRACT

A domestic gas burner comprising a housing with a chamber, which can be coupled to an optionally controlled feed for a gaseous fuel and is in open communication with the environment via flame ports for the purpose of igniting a gas flame. An inlet device is coupled to the housing and comprises an entrance for receiving gaseous fuel, ambient air, and an outlet for feeding a fuel/air mixture to the burner chamber. The entrance and the outlet are in open communication with each other via a fuel channel which extends therebetween and is bounded by a wall. A gas port debouches into the entrance during operation to feed a fuel flow. The entrance allows substantially free entry of ambient air, and the inlet device comprises auxiliary gas means for generating and maintaining a flow of an auxiliary gas, directed toward the outlet, over the wall of the fuel channel.

17 Claims, 3 Drawing Sheets

(58) Field of Classification Search
USPC ..... 126/39 R; 431/354
See application file for complete search history.

(56) References Cited

U.S. PATENT DOCUMENTS

| | | | | | |
|---|---|---|---|---|---|
| 3,968,785 | A | * | 7/1976 | Perl | F23Q 7/22<br>126/39 J |
| 4,303,386 | A | * | 12/1981 | Voorheis | F23C 7/008<br>431/177 |
| 5,468,143 | A | * | 11/1995 | Weber | F23D 14/64<br>431/207 |

FOREIGN PATENT DOCUMENTS

| | | | |
|---|---|---|---|
| EP | 2957831 | A1 | 12/2015 |
| JP | S47026543 | U | 11/1972 |
| JP | S57190229 | U | 12/1982 |
| KR | 20190136540 | A | 12/2019 |
| WO | 2010105515 | A1 | 9/2010 |

* cited by examiner

GAS BURNER AND DOMESTIC APPLIANCE

CROSS REFERENCE TO RELATED APPLICATIONS

This application is a 371 national phase of PCT Application No. PCT/IB2020/061818, filed Dec. 11, 2020, which claims the benefit of the filing date of Netherlands Application No. 2024427, filed Dec. 11, 2019, the contents of which are hereby incorporated by reference in their entirety.

The present invention relates to a gas burner, particularly a domestic gas burner, more particularly a domestic gas burner for a cooking device, comprising a burner housing with a burner chamber which comprises one or more flame ports where a gas flame can be ignited, and comprising an inlet device with a gas intake which is configured to let in a gas flow of a gaseous fuel and with an outlet where a fuel/air mixture can be received, wherein the gas intake and the outlet of the inlet device are in open communication with each other via a fuel channel bounded by a channel wall, wherein the burner chamber can be coupled via the inlet device to an optionally controlled gas feed, and wherein the inlet device comprises at least one air inlet which allows free entry of ambient air to the gas flow. The invention also relates to a domestic appliance provided with such a gas burner.

A domestic gas burner of the type stated in the preamble is known from for instance American patent publication US 399948. In this known burner a gas-air mixture is formed in the inlet device by supplying gaseous fuel and ambient air, which mixture is carried to the burner housing. The ambient air which ends up in the gas-air mixture via the inlet device is also referred to as primary air, and usually produces a sub-stoichiometric mixture. This gas-air mixture can escape via the flame ports and be brought to combustion outside the flame ports. The gas-air mixture which combusts outside the flame ports on the basis of the primary air, also referred to as the primary combustion, comprises combustible residual gases which will combust while being supplied with ambient air. This is also referred to as secondary combustion. This ambient air is also referred to as secondary air. The fuel will here preferably combust completely, and the heat produced thereby can be relinquished to a surface for heating, for instance a bottom of a pan or kettle. The hottest part of the flame is the part in which the primary combustion takes place. In order to achieve an optimal heat transfer from the flame to the pan bottom it is important for the pan bottom to lie close to the hottest part of the flame, the part where the primary combustion takes place. The secondary combustion should not be impeded here.

A flame of a gas burner has a flame length. The flame length is determined by the outflow speed of the gas-air mixture and the flame speed. The outflow speed is determined by the gas feed to the burner. The more gas is supplied, the more primary air is also drawn in, and the outflow speed of the gas-air mixture from the flame ports will increase. The flame speed is determined by the gas composition, the temperature of the gas-air mixture and the availability of primary and secondary air. When the flame speed is sufficiently high relative to the outflow speed, the flame length will be short, wherein the gas-air mixture will combust close to the flame ports. When there is a great supply of gas, the outflow speed increases, whereby the flame length increases. The flame speed can also decrease due to the relatively high proportion of gas in the gas-air mixture, whereby the flame length increases still further. In the case of a further increasing gas feed there is a risk of the flame being blown off the burner, thereby cooling down and being extinguishing. In this situation the flame speed is too low relative to the outflow speed. The heat transfer can be optimized by adjusting the flame length to the distance to the surface for heating.

The secondary combustion of residual gases takes place in a zone relative to the flame ports which lies outside the zone of the primary combustion. The necessary inflow of secondary air is in this case limited by the distance between flame ports and a surface for heating, for instance a pan bottom. The known burner is relatively sensitive thereto. If the inflow of secondary air is insufficient for bringing the gas-air mixture to complete combustion, undesired residual gases can furthermore even escape.

Because the inflow of secondary air must be sufficient to obtain complete secondary combustion, a relatively large distance between gas burner and surface for heating is opted for in prior art gas burners. Due to this relatively great distance, the heat transfer from flame to the surface for heating is sub-optimal. These drawbacks occur particularly in the case of concentric rings of flame ports which lie in a common plane, wherein particularly the inner flame ports can have a secondary air feed which is insufficient to be able to ensure an optimal heat transfer to the pan bottom.

In order to obtain a stable combustion in the case of a variation in gas feed, flame stabilization is applied in prior art gas burners, wherein hot combustion gases are fed back, for instance with a baffle, to the flame ports, whereby the temperature of the outflowing gas-air mixture is increased. This increases the flame speed and achieves that the flame burns close to the flame ports in a determined gas feed range. In prior art gas burners the heat necessary for flame stabilization however causes undesired heating of the burner housing, and is not beneficial to the efficiency of the gas burner.

The invention has for its object, among others, to provide a device in which one or more of these drawbacks are obviated.

In order to achieve the intended object a gas burner of the type stated in the preamble has the feature according to the invention that the inlet device comprises at least one auxiliary gas port which opens into or toward a wall of the inlet device in or close to a path of the ambient air, that the at least one auxiliary gas port is coupled to auxiliary gas means which are able and configured to generate and maintain together with the gas flow a forced auxiliary gas flow, and that the at least one auxiliary gas port feeds the auxiliary gas flow over the wall of the inlet device.

A particular embodiment of the gas burner has the feature here according to the invention that the gas intake comprises the air inlet which allows an inflow of ambient air to the gas flow, that the at least one auxiliary gas port opens into or toward the channel wall of the fuel channel, and that the at least one auxiliary gas port is able and configured to carry the auxiliary gas flow over the channel wall of the fuel channel to the outlet during operation.

The fuel flow, which is fed from the gas feed to the entrance in the gas intake, entrains a flow of primary ambient air which is thus sucked into the inlet device. The invention is here based on the insight that the downstream-directed flow of the auxiliary gas over the wall of the fuel channel creates an underpressure upstream, which enhances this suction and thereby the magnitude of the inflow of ambient air. This provides for a gas-air mixture with a higher proportion of primary air, whereby the combustion of the gas-air mixture at the flame ports will take place at a higher flame speed, and thus closer to the flame ports, wherein the need for secondary air is lower. The higher flame speed further reduces the chance of the flame being blown off and finally being extinguished. This results in a lesser or eliminated need for flame stabilization.

Owing to a more complete combustion, an omission of undesired combustion gases can also be limited to a minimum, or even be zero. Because the combustion of the gas-air mixture takes place closer to the flame ports and there is a lesser need for secondary air, a smaller distance to a surface for heating, for instance a pan bottom, can be opted for, whereby a more optimal heat transfer takes place between the flame and this surface. The improved heat transfer thereby results not only in a higher efficiency but, owing to the improved combustion and lesser need for secondary air, stricter environmental requirements can also be met with a gas burner according to the invention.

It is suspected that the auxiliary gas flow, directed toward the outlet, along the wall of the inlet device produces a drag effect upstream, which thereby has a suctioning effect on the primary ambient air. This effect is enhanced further in a preferred embodiment of the gas burner according to the invention, which is characterized in that a Coandă surface, over which the auxiliary gas flow is received, is provided adjacently of the at least one auxiliary gas port.

In the context of the present application a Coandă surface it is understood to mean at least a surface curved transversely of the flow direction and having a sufficiently low, yet significant radius for the auxiliary gas flow, given the flow speed thereof, to stick thereto and to follow the curvature. The curvature is preferably also preceded by a step or shoulder in the auxiliary gas flow. This forces the auxiliary gas flow in the outside bend to a higher flow speed, whereby an underpressure results here, which is responsible in the gas burner according to this embodiment for an additional suctioning effect on the primary ambient air. The Coandă effect and a surface qualifying therefor is described further in a paper by Imants Reba in Scientific American, Vol. 214, June 1966, pages 84-92, the content of which should be deemed as cited and included herein.

A further particular embodiment of the gas burner according to the invention has the feature that the auxiliary gas port is intended and configured to feed the auxiliary gas flow at an increased speed, at least at the same or a higher speed than the speed of the fuel/air mixture, at least during operation. Feeding the auxiliary gas to the wall of the fuel channel at increased speed enhances the suctioning effect of ambient air, or primary air, at the gas intake.

An embodiment of the gas burner according to the invention has the feature that the inlet device comprises the auxiliary gas port downstream of the gas intake. The supply of the gaseous fuel and primary ambient air on one side and the auxiliary gas flow on the other are in that case independent of each other and separated.

An embodiment of the gas burner according to the invention has the feature that the fuel channel comprises the auxiliary gas port in the wall of the fuel channel.

An embodiment of the gas burner according to the invention has the feature that the auxiliary gas port comprises an inlet gap which opens into the fuel channel and extends over at least a part of a periphery of the wall of the fuel channel, particularly co-axially over at least substantially a whole periphery of the wall of the fuel channel.

An embodiment of the gas burner according to the invention has the feature that the fuel channel widens downstream of the auxiliary gas port. The widening provides for expansion of the auxiliary gas flowing over the wall of the fuel channel to the outlet.

An embodiment of the gas burner according to the invention has the feature that the auxiliary gas port comprises an auxiliary gas channel bounded by a first wall, which wall has a curved surface directed toward the fuel channel. This provides for the creation of a Coandă effect on the auxiliary gas along the wall of the fuel channel which flows out during operation.

An embodiment of the gas burner according to the invention has the feature that the auxiliary gas channel is bounded by a second wall, which second wall has a surface which runs substantially parallel to the first wall of the auxiliary gas channel. This provides for an enhancement of the Coandă effect of the first wall of the auxiliary gas channel with the curved surface directed toward the fuel channel.

An embodiment of the gas burner according to the invention has the feature that the auxiliary gas port can be coupled to auxiliary gas means, which auxiliary gas means comprise gas displacing means. This provides for supply of auxiliary gas. The gas displacing means can start a forced flow of the auxiliary gas and/or place the auxiliary gas under pressure. An embodiment of the gas burner according to the invention has the feature that the gas displacing means comprise at least one of a fan, a propeller, an impeller and a compressor, and particularly comprise a fan or a compressor.

An embodiment of the gas burner according to the invention has the feature that the inlet device comprises Venturi means. The Venturi means can be accommodated in the fuel channel and provide for an improved suction of ambient air when a gas flow is injected into the gas intake of the inlet device during operation.

An embodiment of the gas burner according to the invention has the feature that the auxiliary gas comprises ambient air. The auxiliary gas hereby contributes to the necessary supply of primary air for the gas burner. Furthermore, no separate gas feed is necessary for the supply of the ambient air, nor is supply of a particular gas necessary.

The object of the invention is also achieved in a domestic appliance, particularly a cooking device, characterized in that at least one gas burner according to the invention as described above is provided therein. The increased output of the gas burner and decreased dependence on secondary air enable a greater variety of burner heads which can be situated on the burner housing for the purpose of accommodating the flame ports, such as flat burner heads and burner heads which are able to follow a bottom profile of a pan, such as for instance a curved bottom profile of a wok.

A particular embodiment of the domestic appliance has the feature according to the invention that it comprises at least a first gas burner and a second gas burner according to the invention, that the first gas burner and the second burner comprise respective auxiliary gas ports, and that the respective auxiliary gas ports of the first gas burner and the second gas burner are coupled to shared auxiliary gas means, which auxiliary gas means comprise gas displacing means. By thus selecting the auxiliary gas means for at least two gas burners collectively it is possible to achieve a significant cost saving and greater simplicity of production for a cooking device.

The invention will be further elucidated hereinbelow with reference to an exemplary embodiment and an accompanying drawing. In the drawing.

It is otherwise noted here that the figures are purely schematic and not always drawn to (the same) scale. Some dimensions in particular may be exaggerated to greater or lesser extent for the sake of clarity. Corresponding parts are designated in the figures with the same reference numeral.

Figure 1:
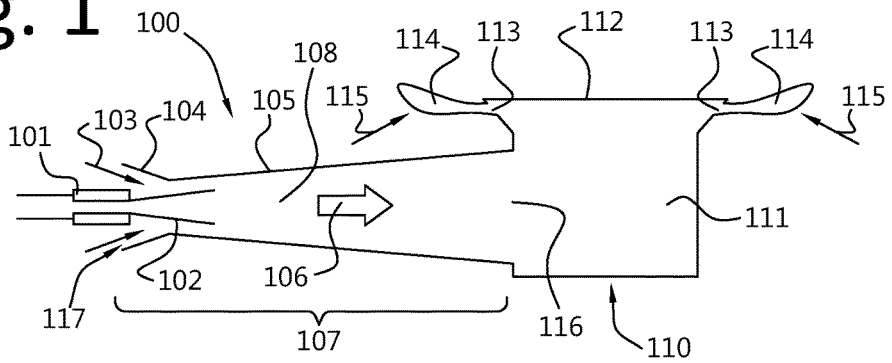
FIG. 1 shows a schematic side view of an exemplary embodiment of a gas burner according to the prior art.

FIG. 1 shows a gas burner 100 according to the prior art, with an optionally controlled gas feed 101 for injecting a gas flow 102, at least a flow of a gaseous fuel, into a gas intake 104 at an entrance 117 of an inlet device 107. Downstream of gas intake 104 the inlet device comprises a fuel channel 108 which is laterally bounded inside inlet device 107 by a channel wall 105. Fuel channel 108 connects entrance 117 to an outlet 116 of the inlet device.

As shown in FIG. 1, gas intake 104 narrows in downstream direction, i.e. toward fuel channel 108. The narrowed outer end of gas intake 104 thereby forms at the transition to fuel channel 108 a constriction, which widens thereafter. Owing to this constriction and subsequent widening a Venturi effect is obtained when the gas flow 102 is injected from gas feed 101 into the entrance 117 of gas intake 104. This Venturi effect creates an underpressure in gas intake 104, whereby primary ambient air is drawn into inlet device 107.

Owing to this Venturi action, the fast-flowing gas flow 102 thus entertains a part ambient air 103, also referred to as primary air, so that a gas-air mixture 106 is carried via fuel channel 108 to the outlet 116 of inlet device 107. Outlet 116 is connected to a burner housing 110 of gas burner 100. The gas-air mixture 106 is thus carried via outlet 116 of the inlet device into a hollow burner chamber 111 of burner housing 110, where a further homogenization of the gas-air mixture occurs.

Burner housing 110 comprises at the position of burner chamber 111 a set of flame ports 113 from which the gas-air mixture can escape from burner chamber 111. Beyond flame ports 113 the gas-air mixture can combust after ignition for the purpose of forming flames 114. The part of burner housing 110 with the flame ports 113 is also referred to as the burner head. In FIG. 1 this burner head 112 is shown on the upper side of burner housing 110, above burner chamber 111, and with the flame ports 113 therein. Burner head 112 can here be placed above burner chamber 111 for removal from burner housing 110, or form a whole therewith.

The gas-air mixture of gas flow 106 which flows into burner chamber 111 has a sub-stoichiometric composition, i.e. the gas-air mixture composition has a limited excess of gas 102 relative to the primary air 103. Partly due to the imposed outflow speed of the gas-air mixture via flame ports 113, the gas-air mixture will thereby not ignite until outside flame ports 113. The previously supplied primary air 103 in the gas-air mixture now provides for an initial incomplete primary combustion in a first zone outside flame ports 113. Residual gases of the primary combustion are further brought to secondary combustion in a second zone while being supplied with secondary air 115. This second zone lies further removed from the flame ports than the first zone in which the primary combustion occurred. The secondary combustion of residual gases in the second zone is complete owing to this entry of secondary ambient air 115.

Figure 2:
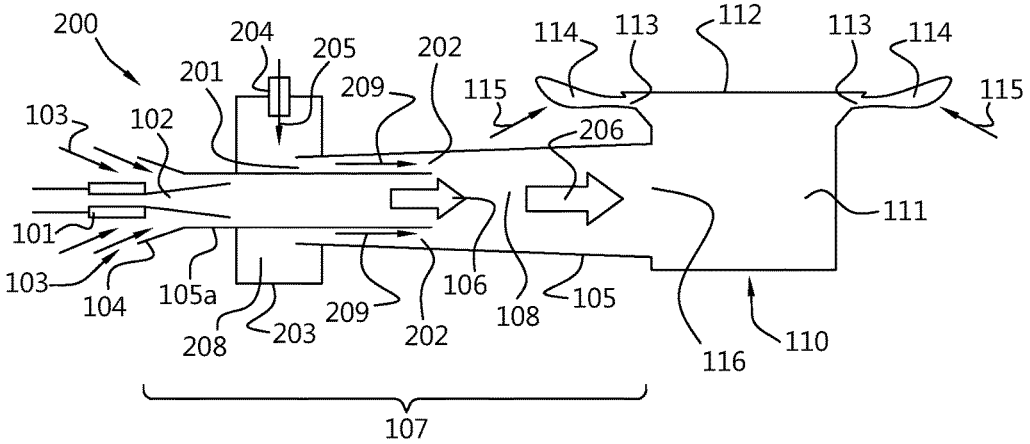
FIG. 2 shows a schematic side view of a first exemplary embodiment of a gas burner according to the invention.

FIG. 2 shows a gas burner 200 according to an exemplary embodiment of the invention. Use is here also made of a gas burner in the form of a burner housing 110 with, coupled thereto, an inlet device 107 which provides the burner housing with a gas-air mixture, largely as described with reference to the gas burner of FIG. 1. The device shown in FIG. 2 however comprises in inlet device 107 an auxiliary gas port 202 which opens toward the wall 105 of fuel channel 108. Auxiliary gas port 202 is coupled to auxiliary gas means 203 which generate and maintain a forced gas flow 209 during operation. This auxiliary gas flow 209 flows here via auxiliary gas port 202 over the wall 105 of fuel channel 108.

Auxiliary gas port 202 is here formed by a co-axial gap which extends over a periphery of the wall 105 of fuel channel 108 and which is upstream in open communication with an air chamber 208. Fuel channel 108 is thus divided into two parts, i.e. a first part 105*a* upstream of auxiliary gas port 202, as seen in the flow direction of the gas 106 in fuel channel 108, and a second part 105*b* downstream of auxiliary gas port 202. Upstream of auxiliary gas port 202 the channel wall 105 takes a double-walled form and thus comprises a cavity 201 which serves as feed channel for the auxiliary gas. Via this feed channel 201 the auxiliary gas 205 is supplied by the auxiliary gas means 203 and forced to the auxiliary gas port 202. The flush orientation of the auxiliary gas port 202 ensures that this forced auxiliary gas flow 209 is fed along the wall 105 of fuel channel 108, in the direction toward outlet 116.

This auxiliary gas flow 209 'sticks' to wall 105 here and creates a drag effect, with the result that an increased underpressure, i.e. a lower pressure, is thereby created in the part 105*a* of channel 108 lying upstream. This in turn provides for an increase in the suctioning effect for primary ambient air 103 at the entrance 117 of the inlet device, whereby the inflow of primary ambient air 103 is enhanced. The subsequently enriched gas-air mixture 206 still maintains a sub-stoichiometric composition, but thus obtains a higher ambient air content than if no auxiliary gas flow 209 were generated. The combustion in the flames 114 outside flame ports 113 hereby becomes less dependent on the secondary ambient air 115. The outflow speed in flame ports 113 moreover becomes higher due to the increased overall gas flow 206 of the gas-air mixture. In combination with a higher flame speed, this results in a combined action which prevents the flames from being blown off.

Any gas is per se suitable for the auxiliary gas flow 209 to increase the underpressure in inlet 104 thereby. Ambient air is however preferably also applied for this purpose, since this is immediately available from the surrounding area and moreover makes an additional contribution to the proportion of air in the gas-air mixture. For this purpose the auxiliary gas means 203 comprise gas displacing means 204, such as a fan, propeller, impeller or compressor, whereby ambient air 205 is drawn in from the surrounding area in forced manner and is supplied to the auxiliary gas port 202. A power source for the gas displacing means can be of electrical nature, for instance an electric motor which is powered by a battery or a local power grid, but gas flow 102 can also serve as drive of a propeller or impeller, which is coupled directly to the gas displacing means, for instance via a shared rotation shaft or a transmission, or which drives a dynamo which powers a battery for the gas displacing means.

Alternative exemplary embodiments of the gas burner according to the invention will be further elucidated hereinbelow with reference to FIGS. 3, 4 and 5. The relevant auxiliary gas port is here always coupled to gas displacing means of auxiliary gas means in the same way, so that the auxiliary gas port will feed a forced auxiliary gas flow of ambient air, as is also the case in FIG. 2. For the sake of clarity of the figures these auxiliary gas means are however not further shown in FIGS. 3, 4 and 5.

Figure 3:
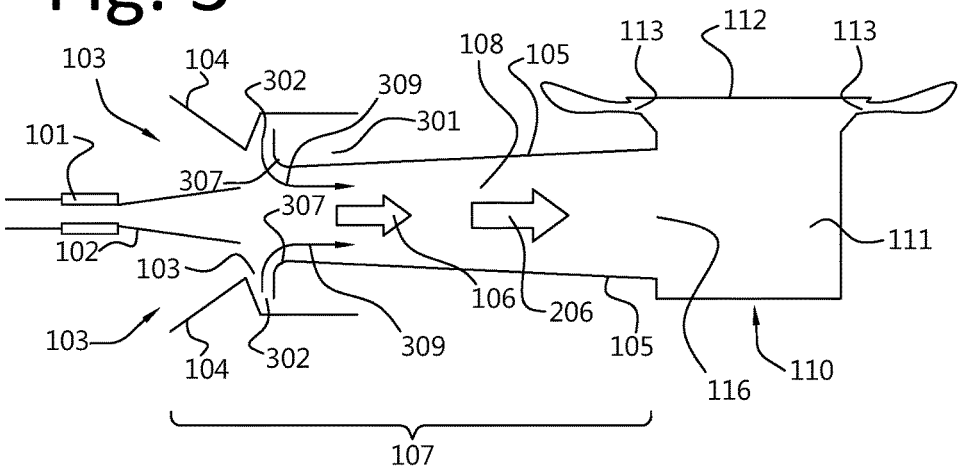
FIG. 3 shows a schematic side view of a second exemplary embodiment of a gas burner according to the invention.

FIG. 3 shows a gas burner 300 according to a second embodiment of invention. The construction is largely the same as that of the first example and comprises a supply channel 301 for the auxiliary gas, in this case once again ambient air, which debouches into an auxiliary gas port 302 close to an inner wall 105 of inlet device 107. Adjacently of auxiliary gas port 302 the inner wall 105 comprises a curvature 307 which provides a Coandă surface over which the forced auxiliary gas flow 309 is carried when it leaves auxiliary gas port 302. This curved surface then transposes smoothly into the inner wall 105 of fuel channel 108.

The convex, curved Coandă surface 307 which connects to the auxiliary gas port 302 produces a so-called Coandă effect for the auxiliary gas 309 flowing from the auxiliary gas port 302. The auxiliary gas flow 309 'sticks' to this surface 307 so that the auxiliary gas flow 302 follows the curvature thereof. The radius of the curved surface here forces the outflowing gas to a greater flow speed, whereby a pressure decrease occurs at the position of curvature 307. This pressure decrease provides for an increased suctioning effect for the primary ambient air 103, whereby the proportion of ambient air in gas flow 206 is further increased. The radius of the curved surface and the dimensions and position of the auxiliary gas port are chosen in accordance with the intensity of the auxiliary gas flow, such that this effect is optimally manifested. For a closer examination of this Coandă effect reference is made to a paper by Imants Reba in Scientific American, Vol. 214, June 1966, pages 84-92.

Figure 4:
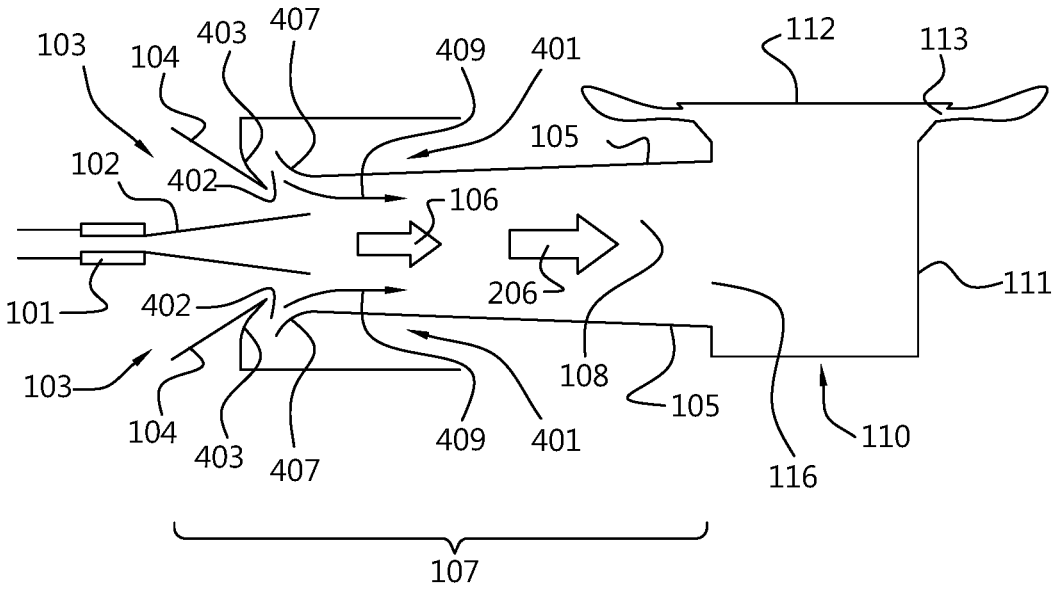
FIG. 4 shows a schematic side view of a third exemplary embodiment of a gas burner according to the invention.

FIG. 4 shows a variant of the gas burner of FIG. 3, wherein the auxiliary gas port 402 not only connects to a wall part 407 of inlet device 107 with curved Coandă surface; but also has an opposite wall 403 with a curvature which follows substantially the curvature of Coandă wall 407. A curved auxiliary gas channel which imparts a curvature to the auxiliary gas flow is thus enclosed between the two wall parts 403, 407. The auxiliary gas flow 409 from the auxiliary gas port 402 will now be deflected and be carried to the Coandă surface not only by the Coandă effect of the adjacent wall part 407 but also by the curvature of the opposite wall 403.

Figure 5:
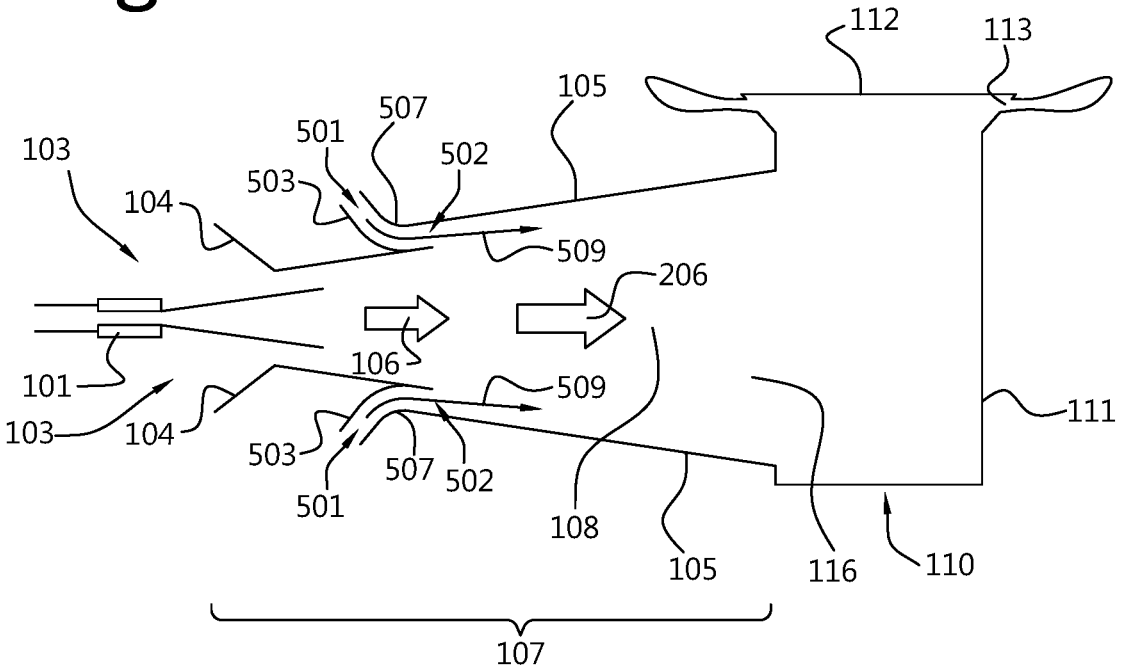
FIG. 5 shows a schematic side view of a fourth exemplary embodiment of a gas burner according to the invention.

FIG. 5 shows a hybrid form of the gas burner of FIG. 2 and the gas burner of FIG. 4, wherein the auxiliary gas port 502 opens into wall 105 of fuel channel 108 at a position removed further downstream from gas intake 104. As in the preceding examples, the auxiliary gas port comprises a co-axial gap which extends all the way around over the periphery of channel 108 and which is fed with a forced auxiliary gas flow of ambient air by auxiliary gas means via a supply channel 501 provided for this purpose. In this example the auxiliary gas port 502 opens toward the flat wall 105 of fuel channel 108, but has upstream a Coandă surface 507 which is provided by the curved auxiliary gas channel 501 between a first wall 503 and a second wall 507, these each having a curved progression as in FIG. 4.

Figure 6:
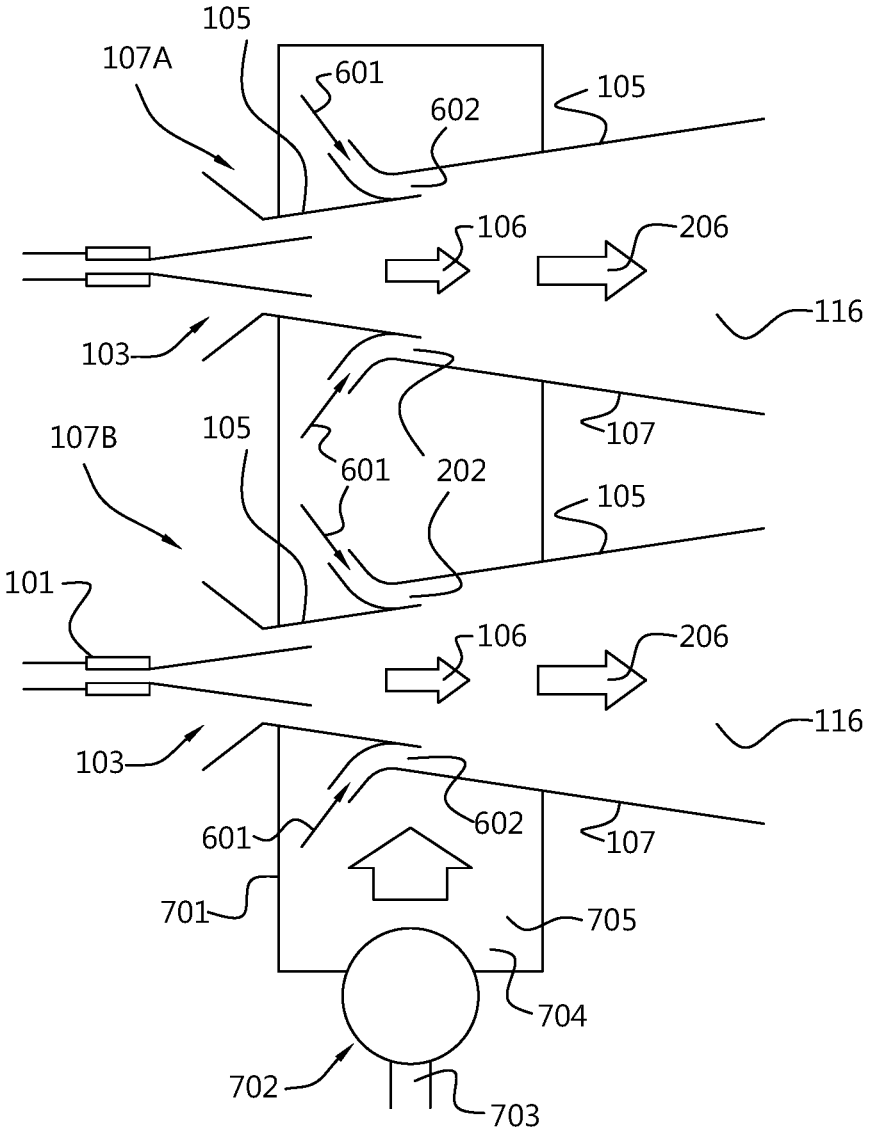
FIG. 6 shows a schematic top view of an exemplary embodiment of a gas burner assembly according to the invention.

FIG. 6 shows schematically a gas burner assembly, wherein two inlet devices 107A, 107B according to FIG. 5 are provided with shared auxiliary gas means 701 . . . 705 for a supply of a forced flow of ambient air as auxiliary gas. It will be apparent to a person skilled in the art that the example of FIG. 6 is not limited to the inlet devices 107A, 107B according to FIG. 5, but that the inlet devices of the other exemplary embodiments, as shown in FIGS. 2, 3 and 4, can also be applied. The respective burner housings 110 have been omitted in FIG. 6 for the sake of clarity.

The two inlet devices 107A, 107B are with their auxiliary gas inlet 601 in open communication with a shared air chamber 701, 705, so that there is no pressure difference therebetween. The two gas burners are fed equally with respective forced auxiliary gas flows 602 by means of shared auxiliary gas means 701 with air displacing means 702 which extract ambient air 703 from the environment. For this purpose the shared air displacing means 702 comprise for instance a fan, propeller, impeller or compressor whereby ambient air is drawn in. Because of their complex structure, air chamber 704, auxiliary gas ports 601 and inlet devices 107 of the respective gas burners, at least parts thereof, can be accommodated in a shared housing 701, which can be formed wholly or partially from plastic or metal, for instance with 3D additive manufacturing techniques.

A domestic appliance, particularly a cooking device, according to the invention comprises a housing wherein one or more gas burners, for instance as apparent from FIGS. 2-5, or a gas burner assembly according to FIG. 6 is accommodated. The gas burners or the gas burner assembly is mounted in the housing at the intended location, for instance with supports. The burner housing with the flame ports of each gas burner is here placed on the free upper side of the housing so that a bottom of a pan can be placed above the flame ports, while being supplied with secondary ambient air.

The housing is provided with a connection for the gas feed 101 of gas inlet 102, which can for instance be connected via a gas hose to a domestic connection. The appliance can however also belong to a separate gas bottle which can in that case be connected to the gas connection. The gas feed can be provided with a gas controller for controlling the supply of the gas. The housing additionally provides a supply opening for ambient air which can be drawn in by the gas burners as primary air and moreover serves to supply auxiliary gas for the auxiliary gas means. The inlet device of the at least one gas burner is provided with auxiliary gas port and auxiliary gas feed, accommodated in the housing, to be able to allow the at least one gas burner or gas burner assembly to operate as according to the invention, as described above.

Although the invention has been further elucidated above on the basis of only a single exemplary embodiment, it will be apparent that the invention is by no means limited thereto. On the contrary, many variations and embodiments are still possible within the scope of the invention for a person with ordinary skill in the art. The flame ports and outflow angles of the gas-air mixture associated therewith are thus shown directed laterally in the figures, whereby the flames are oriented partially horizontally. Other outflow angles, such as diagonal or vertical, can however also be envisaged by the skilled person.

In the figures the channel wall of the fuel channel is drawn with a widening toward the outlet. These walls could also progress toward the outlet without widening. These walls could also have a curved progression, for instance a spiral progression, so as to enable integration into a cooking device.

The auxiliary gas port is described in the above as a gap in or toward the wall of the inlet device. In an alternative embodiment the auxiliary gas port could also be formed by a plurality of gaps or openings which are arranged in the wall over the periphery, which gaps or openings can be mutually connected with a shared supply channel for auxiliary gas.

The invention claimed is:

1. A gas burner, particularly a domestic gas burner, more particularly a domestic gas burner for a cooking device, comprising a burner housing with a burner chamber which comprises one or more flame ports where a gas flame can be ignited, and comprising an inlet device with a gas intake which is configured to let in a gas flow of a gaseous fuel and with an outlet where a fuel/air mixture can be received, wherein the gas intake and the outlet of the inlet device are in open communication with each other via a fuel channel bounded by a channel wall, wherein the burner chamber can be coupled via the inlet device to an optionally controlled gas feed, and wherein the inlet device comprises at least one air inlet which allows free entry of ambient air to the gas flow, wherein the inlet device comprises at least one auxiliary gas port which opens into or toward a wall of the fuel channel of the inlet device in or close to a path of the ambient air, wherein a Coanda surface is provided adjacently of the at least one auxiliary gas port, wherein the at least one auxiliary gas port is coupled to auxiliary gas means which are able and configured to generate and maintain together with the gas flow a forced auxiliary gas flow, and wherein the at least one auxiliary gas port feeds the auxiliary gas flow via said Coanda surface over the wall of the fuel channel of the inlet device.

2. The gas burner according to claim 1, wherein the gas intake comprises the air inlet which allows an inflow of ambient air to the gas flow, that the at least one auxiliary gas port opens into or toward the channel wall of the fuel channel, and wherein the at least one auxiliary gas port is able and configured to carry the auxiliary gas flow over the channel wall of the fuel channel to the outlet during operation.

3. The gas burner according to claim 1, wherein the auxiliary gas port is intended and configured to feed the auxiliary gas flow at an increased speed, at least at the same or a higher speed than the speed of the fuel/air mixture, at least during operation.

4. The gas burner according to claim 1, wherein the fuel channel comprises the auxiliary gas port downstream of the gas intake.

5. The gas burner according to claim 1, wherein the fuel channel comprises the auxiliary gas port in the wall of the fuel channel.

6. The gas burner according to claim 1, wherein the auxiliary gas port comprises an inlet gap which opens into the fuel channel and extends over at least a part of a periphery of the wall of the fuel channel, particularly coaxially over at least substantially a whole periphery of the wall of the fuel channel.

7. The gas burner according to claim 1, wherein the fuel channel widens downstream of the auxiliary gas port.

8. The gas burner according to claim 1, wherein the auxiliary gas port comprises an auxiliary gas channel bounded by a first wall, which first wall has a curved surface directed toward the auxiliary gas channel.

9. The gas burner according to claim 8, wherein the auxiliary gas channel is bounded by a second wall, which second wall has a surface which runs substantially parallel to the first wall of the auxiliary gas channel.

10. The gas burner according to claim 1, wherein the auxiliary gas means comprise gas displacing means.

11. The gas burner according to claim 10, wherein the gas displacing means comprise at least one of a fan, a propeller, an impeller and a compressor.

12. The gas burner according to claim 1, wherein the inlet device comprises Venturi means.

13. The gas burner according to claim 1, wherein the auxiliary gas comprises ambient air.

14. A domestic appliance, particularly a cooking device, wherein at least one gas burner according to claim 1 is provided therein.

15. A domestic appliance, comprising a first gas burner and a second gas burner, each of the first gas burner and the second gas burner according to claim 1, wherein the first gas burner and the second burner comprise respective auxiliary gas ports, and wherein the respective auxiliary gas ports of the first gas burner and the second gas burner are coupled to shared auxiliary gas means, which auxiliary gas means comprise gas displacing means.

16. The gas burner according to claim 1, wherein the Coandă surface comprises a surface curved transversely to the gas flow of the gaseous fuel.

17. The gas burner according to claim 16, wherein the Coandă surface is preceded by a step or shoulder in the gas flow of the gaseous fuel.

* * * * *